United States Patent [19]

Hagney

[11] 4,205,405

[45] Jun. 3, 1980

[54] CONVERTIBLE SOFA-BED

[76] Inventor: Gerald L. Hagney, 315 E. Bennett Ave., Glendora, Calif. 91740

[21] Appl. No.: 931,195

[22] Filed: Aug. 4, 1978

[51] Int. Cl.[2] ..... A47C 17/10

[52] U.S. Cl. ..... 5/44 R; 5/27; 5/37 R; 297/342

[58] Field of Search ..... 5/12, 13, 17, 18 R, 5/18 B, 28, 30, 37 R, 37 B, 43, 44 R, 46; 297/62, 92–94, 112, 318, 342, 354

[56] References Cited

U.S. PATENT DOCUMENTS

| | | | |
|---|---|---|---|
| 3,299,446 | 1/1967 | Blise et al. | 5/17 |
| 3,634,893 | 1/1972 | Hern et al. | 5/37 R |
| 3,913,152 | 10/1975 | Quackenbush | 5/18 R |

*Primary Examiner*—Casmir A. Nunberg

*Attorney, Agent, or Firm*—Boniard I. Brown

[57] ABSTRACT

A convertible sofa-bed apparatus for use in a sofa or a bed configuration has hingedly interconnected and supported by frame members, and one or more pivotable arms or swing arms pivotally connected with frame members and with the seat cushion unit. The pivotable arms are rotatable between a back horizontal position wherein the apparatus is in its sofa configuration, and a frontward horizontal position wherein the apparatus is in its bed configuration. The pivotable arm or arms are preferably secured to a cross-bar rotatably mounted between end frame members to support the back cushion unit in either a vertical sofa configuration or a horizontal bed configuration, and the back support arms are preferably spring-biased to urge the arm toward such vertical position.

14 Claims, 14 Drawing Figures

FIG. 4.
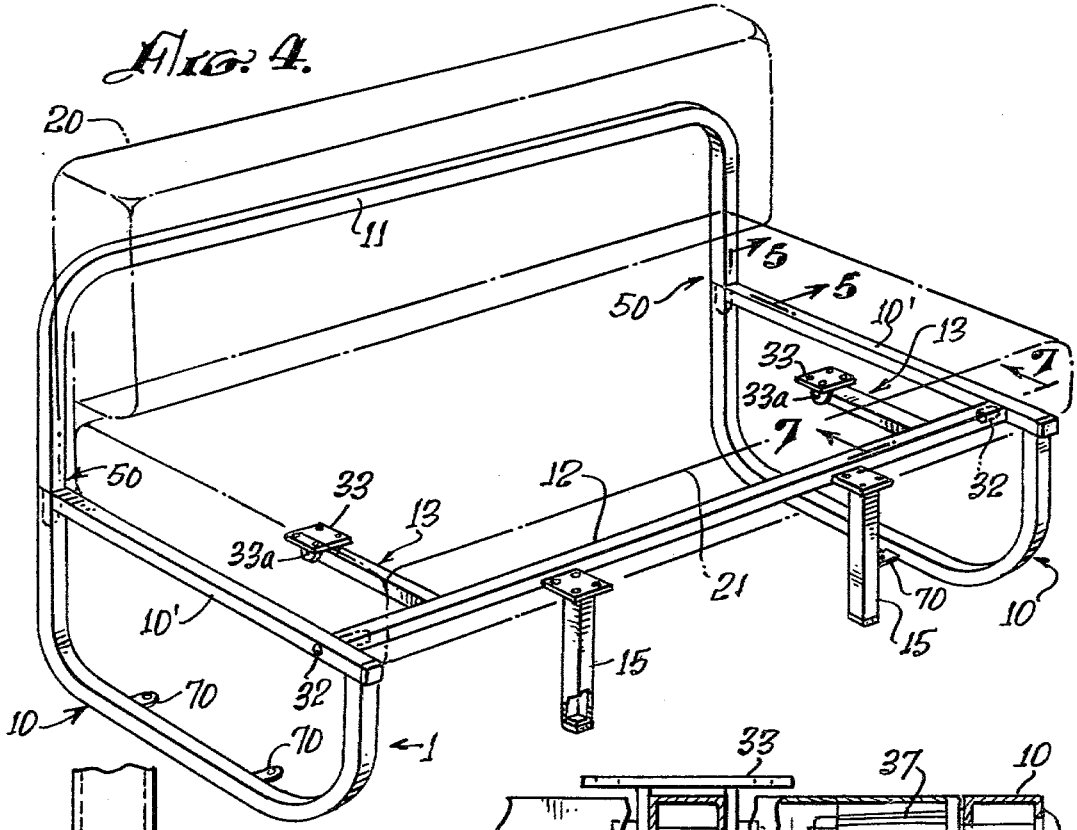
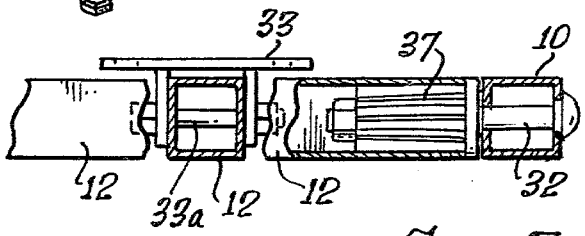
FIG. 7.
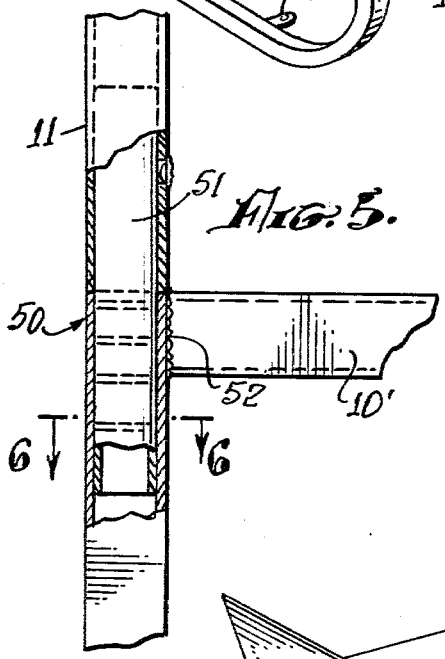
FIG. 5.
FIG. 6.
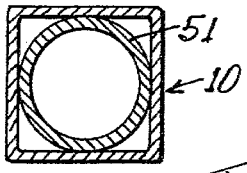
FIG. 8.
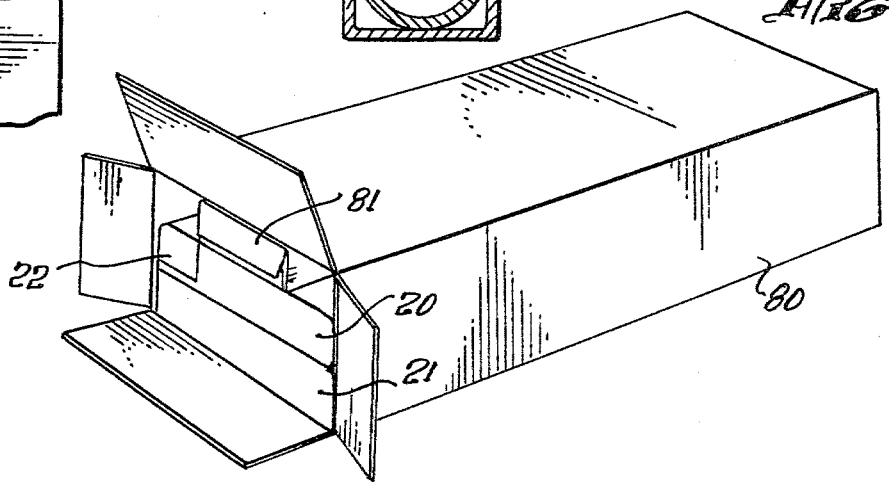

FIG. 9.
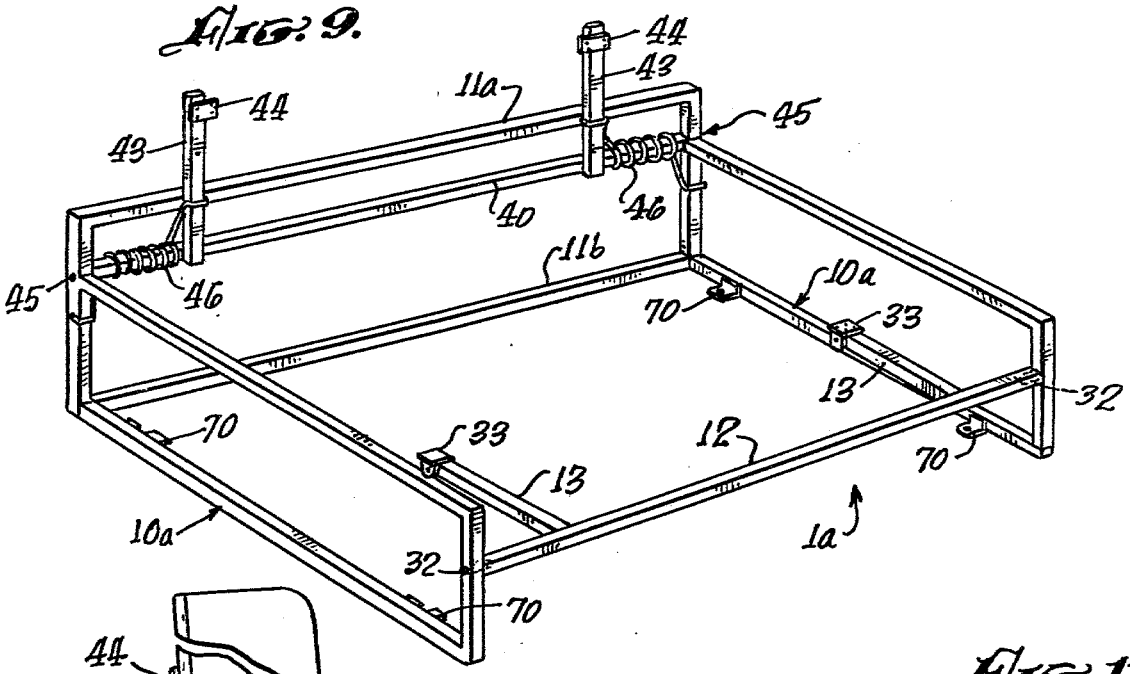
FIG. 11.
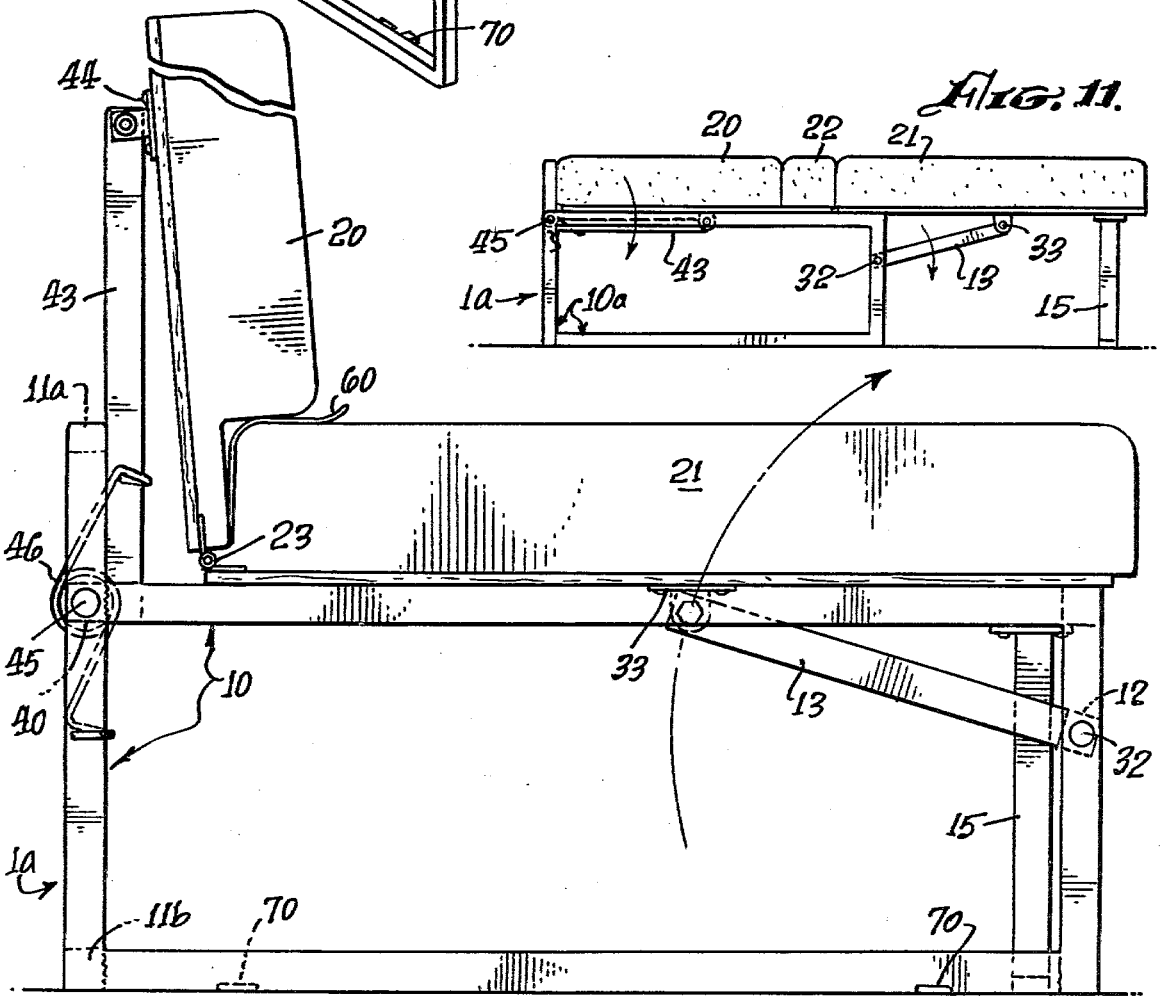
FIG. 10.

CONVERTIBLE SOFA-BED

BACKGROUND OF THE INVENTION

1. Field of the Invention

The invention relates to convertible sofa-bed apparatus for use in their a sofa or a bed configuration.

2. Prior Art

Convertible sofa-bed apparatus of the general class to which this invention pertains, have heretofore been devised. For example, apparatus of the general type is shown in U.S. Pat. No. 1,061,533 to Englander, and in French Pat. No. 650,393 to Du Crot, which patents relate to apparatus having pivoted or sliding components for conversion between bed and sofa configurations.

SUMMARY OF THE INVENTION

The present invention provides improved convertible sofa-bed apparatus which is conveniently and quickly convertible between its bed configuration and its sofa configuration. A seat cushion unit and a back cushion unit are hingedly interconnected and are supported by frame means including end frame members and rotatable cross-members, which are preferably of rectilinear cross-sections. One or more pivotable arms or swing arms are pivotally mounted to the seat cushion unit and to the frame means, typically being secured through a cross-bar rotatably mounted between the end frames. The pivotable arms or swing arms are rotatable, by manual urging of the sofa cushion unit through one-half revolution between a back horizontal position of the arms wherein the apparatus is in its sofa configuration, and a frontward horizontal position of the arms wherein the apparatus is in its bed configuration. The back cushion unit is displaced downwardly and frontwardly via its hinged interconnection with the seat cushion unit, into a horizontal position adjacent to the seat cushion unit into the bed configuration of the apparatus. In either the sofa or the bed configuration of the apparatus, these pivotable arms are horizontally disposed adjacent to the seat cushion units, thus leaving the space under the cushion unit clear for storage or mounting of objects such as tanks, suitcases or travel gear, thus to conserve space, as in recreational vehicles. A gap which occurrs between the back and seat cushion units with the apparatus in its bed configuration, is preferably filled by inserting therein detachable arm rests which, in the sofa configuration of the apparatus, are detachably mounted by conventional means atop the seat cushion unit.

The apparatus may preferably include one or more pivotable back cushion unit support arms, preferably secured to a back bar rotatably mounted between the end frames, and rotatable between the vertical position wherein the arms support the back cushion unit in a sofa configuration of the apparatus, and a horizontal position wherein the arms support the back cushion unit in the bed configuration of the apparatus. The back support arms may preferably be spring-urged toward their vertical position wherein they support the back cushion unit in the sofa configuration of the apparatus, thus to facilitate the manual urging of the apparatus into its sofa configuration. The spring-bias means may preferably comprise helical torsion springs disposed about end portions of the back bar, or alternatively about stub bars rotatable relative to the end frames, and acting between the back cushion support arms and the end frames.

The apparatus is designed with detachable members for disassembly for convenient, compact packaging for shipping and storage.

BRIEF DESCRIPTION OF THE DRAWINGS

FIG. 4 is a perspective view of the frame and associated components utilized with the invention;

FIG. 5 is an enlarged sectional view taken at line 5—5 in FIG. 4;

FIG. 6 is an enlarged sectional view taken at line 6—6 in FIG. 5;

FIG. 7 is a partial sectional view taken at line 7—7 in FIG. 4;

FIG. 8 is a perspective view of a carton arrangement in which the apparatus of the invention may be packaged;

FIG. 9 is a perspective view of a frame and associated components utilized with a modified form of the invention;

FIG. 10 is an enlarged elevational sectional view of the apparatus of FIG. 9, showing the apparatus in its sofa configuration;

FIG. 11 is a side elevational view showing the apparatus of FIG. 9 in its bed configuration, together with back and feet cushion units;

DESCRIPTION OF THE PREFERRED EMBODIMENT

Figure 1:
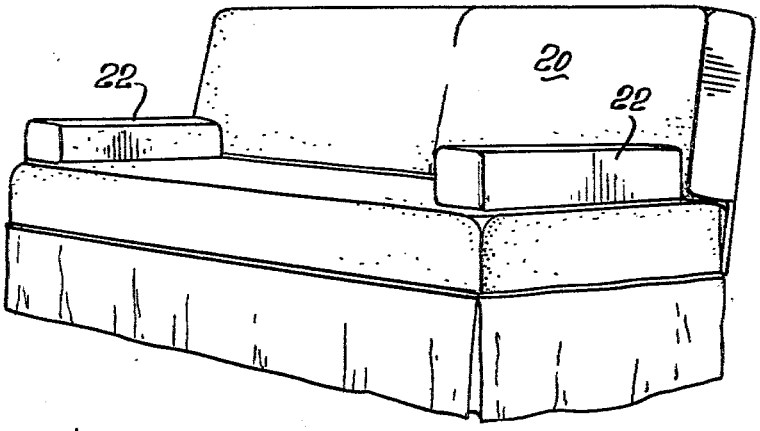
FIG. 1 is a perspective view of a sofa-bed embodying the invention.
Figure 2:
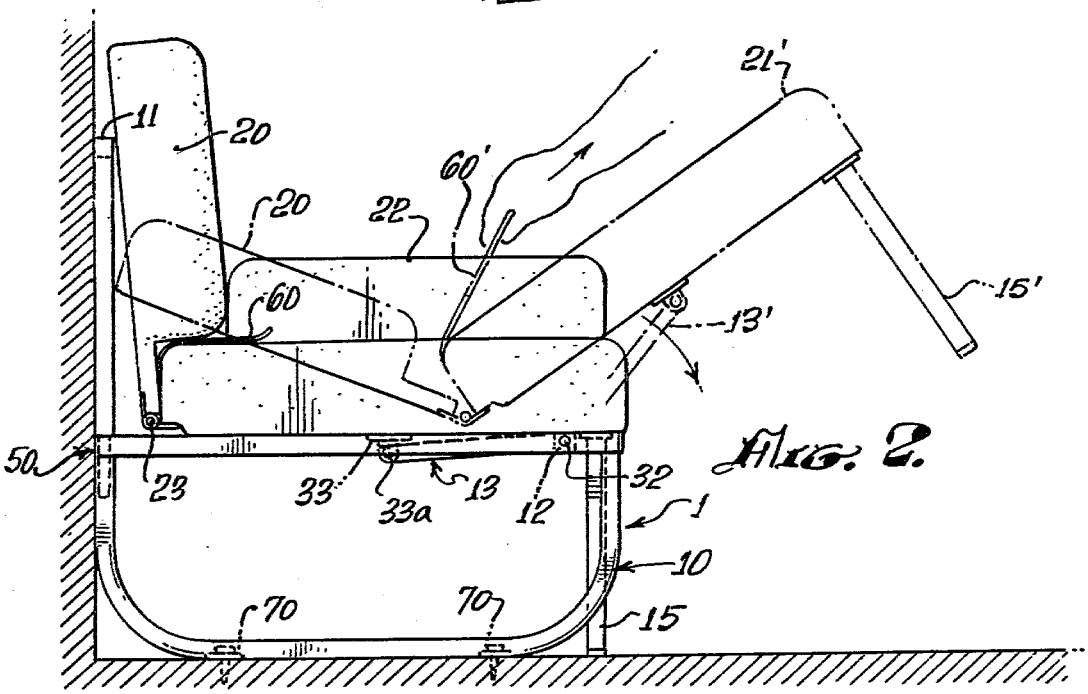
FIG. 2 is an enlarged side elevational view of the sofa-bed apparatus of FIG. 1, showing the apparatus in its sofa configuration, and showing in phantom outline the apparatus in a configuration intermediate its sofa and its bed configurations.

Referring to FIGS. 1, 2 and 4, a preferred form of the invention includes a frame 1 comprising a pair of vertical end frames 10, 10' interconnected by a back frame member or bar 11, a pair of pivotable arms 13, 13, a back cushion unit 20, a seat cushion unit 21, and arm rests 22, 22. The seat and back cushion units are hinged together at 23, and preferably have stiff backings of plywood or the like (not shown).

A pair of arms 13, 13 are secured, as by welding, to a cross-member or bar 12 which is rotatably mounted at its end portions on the end frame members, as shown in detail in FIG. 7. A pivot bolt 32 extends through an opening in each of end frames 10, 10' and into the hollow end portion of bar 12, wherein it is secured by a plastic plug 37 which expands upon the tightening of bolt 32, in conventional manner. FIG. 7 also illustrates the interconnection of support arm 13 with bar 12, bolts **33*a* being the pivot element for arm 13**.

Mounting brackets 33 are secured, as by welding, at the outer end portions of the arms 13 for the securement of the arms to the bottom of seat cushion unit 21 by appropriate fasteners or screws.

In the operation of the apparatus and its shifting between a sofa and a bed configuration, referring to FIGS.

2, 3, and 4, a pull strap 60 is manually pulled to exert force at the pivotal connection 23 and on seat cushion unit 21 to move it and back cushion unit 20 in the manner indicated in FIG. 2, the motion being guided and controlled by arms 13 which pivot with the front cross-bar 12, and the pivotal interconnections of which with seat cushion unit 21 describe a circular arc, indicated by the arrow in FIG. 2, of one-half revolution or 180° between their back horizontal position (FIG. 2) in which the apparatus is in its sofa configuration, and its frontward horizontal position (FIG. 3) in which the apparatus is in its bed configuration. To change the apparatus from its bed to its sofa configuration, the frontward portion of the seat cushion unit 21 is manually lifted and urged toward the back of the apparatus, the pivot bar 13 controlling and guiding movement of the back and seat cushion units, the back cushion unit 20 being moved toward the back and upwardly by means of the hinged connection 23. The movement of the components between the sofa and bed configurations is thus automatically controlled and guided by the pivot bars 13.

In the bed configuration, the frontward portion of seat cushion unit 21 is supported by support legs 15, the back portion being supported on end frames 10, 10' and bar 12. In the sofa configuration, the legs 15 are positioned or stored adjacent to the respective end frames, as indicated in FIG. 2.

Figure 3:
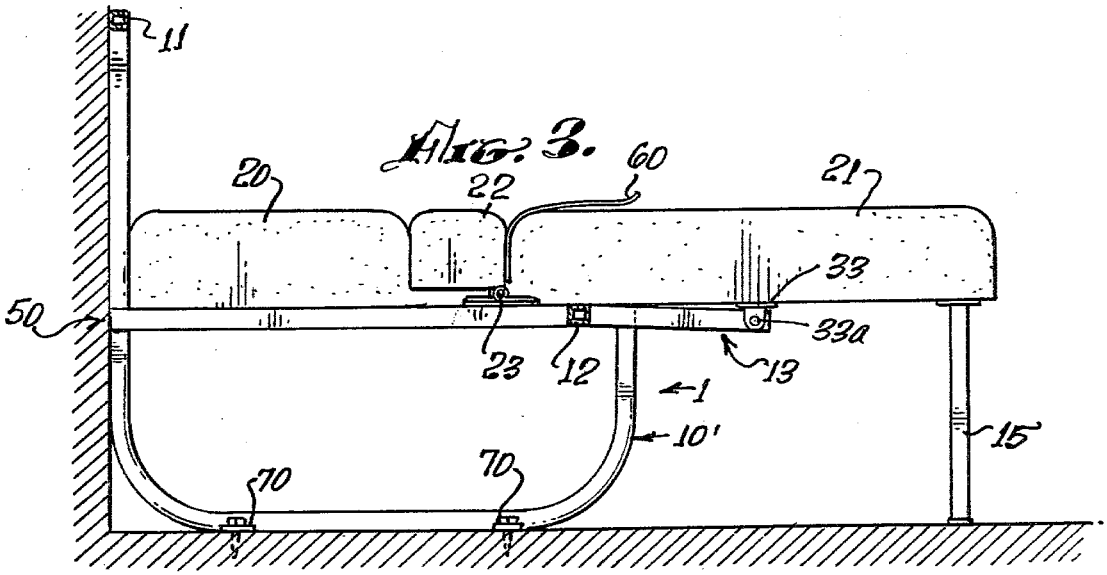
FIG. 3 is a side elevational view of the apparatus of FIG. 2 in its bed configuration.

The gap between the back and seat cushion units when in their bed positions, is filled by the detachable arm rests 22 which are conventionally insertable in the gap, as indicated in FIG. 3, and which are detachably positioned atop the seat cushion unit by conventional means when the unit is in its sofa configuration.

The frame members are preferably fabricated of steel tubing of rectilinear cross-section. End frame members 10, 10' are preferably welded to member 11, as shown at 52. The sectional view of FIG. 6 shows filler 51, preferably of circular tubing and sized to fit closely within the square tubing of frame members 10, 11.

The apparatus may be secured to a floor, as for use in a recreational vehicle, by the provision of appropriate securement tabs 70 and fasteners such as screws extending through openings in the tabs into a floor member.

Back frame member 11 is preferably detachable from the end frames, as at 50, 50 to facilitate disassembly for packaging, shipment and storage. An appropriate joint for this purpose is shown in FIG. 5, wherein the back frame member 11 is shown abutting the top of end frame member 10, with a short filler element fitted tightly within both members.

Shown in FIG. 8 is a carton arrangement wherein the complete device is compactly packaged for shipment and storage. Carton 80 is only as long as the sofa and as wide as the seat. An inner carton 81 may contain the frame members in flat array, the frame member 11, bar 12, bar 12 arms 13, legs 15 and the fastening elements, while other cartons respectively contain the back seat member, the seat cushion member and the arm rests. The apparatus is adapted for such compact packaging for shipment and storage by the detachable connections of the components, thus economizing substantially on shipping and handling expense and storage space.

FIGS. 9–14 illustrate a modified form of the apparatus of the invention, which differs from the embodiment of FIGS. 1–8 essentially in the utilization of additional longitudinal frame members for rigidity, the provision of pivotable back cushion support arms on a rotatable bar, and biasing springs which assist in movement of the apparatus between its bed and its sofa configuration.

End frames **10*a* may preferably have square welded corners instead of partially bent and rounded ones, but are otherwise like end frames 10, 10' of FIGS. 2 to 4. Support arms 13 and bar 12 are like the corresponding elements of the earlier described embodiment of FIGS. 2 to 4**.

A pair of pivotable arms 43, 43 are secured, as by welding to a back bar 40 which is pivotably mounted at 45, 45 to end frames **10*a*, 10*a* in a manner similar to the mounting of the bar 12. End brackets 44, 44 on the end portions of the arms are secured to the back of the back cushion unit 20 in the same manner as the arm brackets 33 are secured to the seat cushion unit. The back support arms 43 rest against back frame member 11*a* in the sofa configuration of the apparatus. Back frame member 11*a* can thus be positioned closer to a supporting floor than the bar 11 of FIG. 4**.

An additional back frame member **11*b* (FIG. 9) is preferably provided for increased rigidity of the frame. Members 11*a*, 11*b* are detachably mounted to the end frames 10*a*** by any appropriate fastening means (not shown).

Biasing springs 46 are provided to assist an operator in moving the apparatus from its bed to its sofa configuration. The back support arms 43 are spring-urged toward their vertical or sofa position by the helical torsion springs 46 (FIGS. 9 and 13), each of which springs has one end portion hooked about one of the end frame members **10, 10*a* and its other end portion hooked about one of the arms 43**.

The operation of the sofa-bed apparatus FIGS. 9–14 is otherwise similar to that earlier described relative to the embodiment of FIGS. 1–8.

Figure 12:
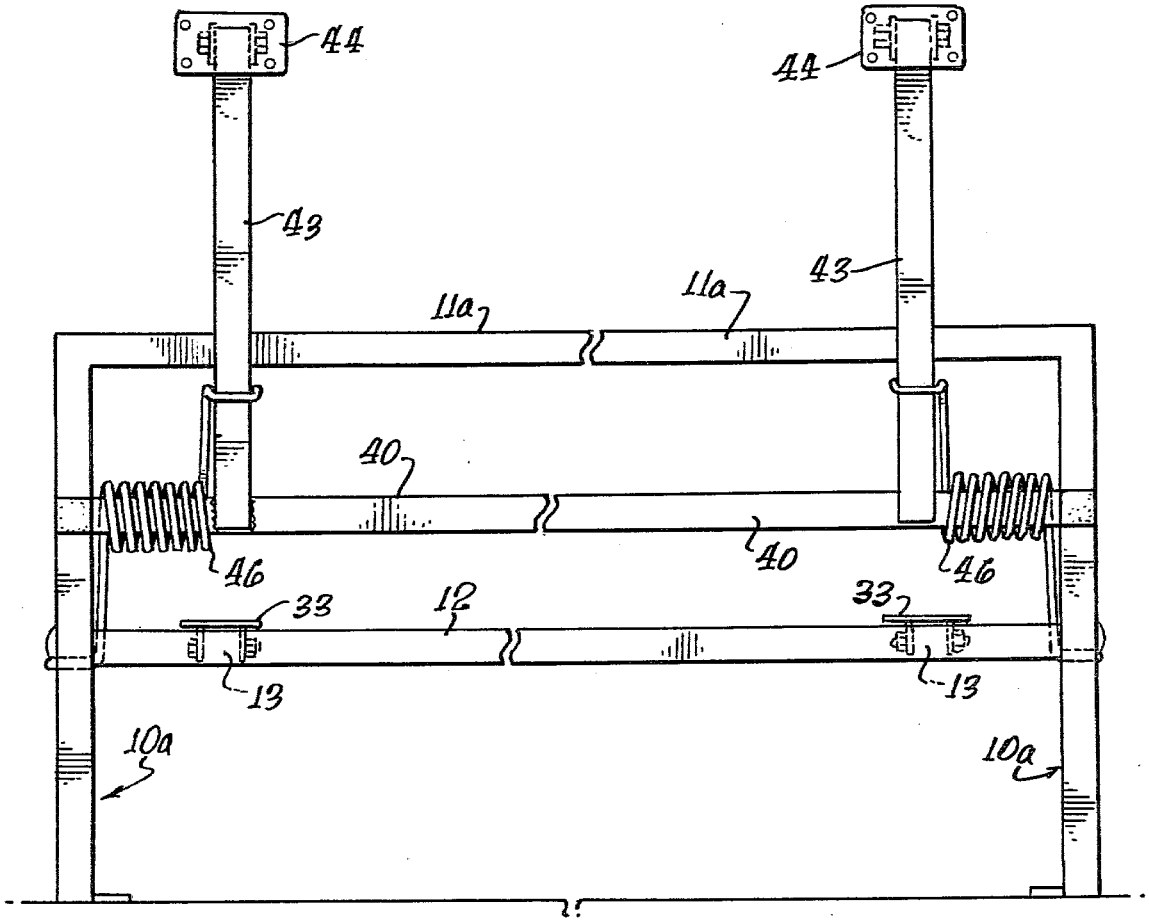
FIG. 12 is a front view of the frame and associated components of a modified form of the apparatus of FIG. 9.

FIG. 12 illustrates a further modification wherein the lower back frame member **11*b* of the form shown in FIG. 9, is not utilized, and which is otherwise like the form of FIG. 9**.

Figure 14:
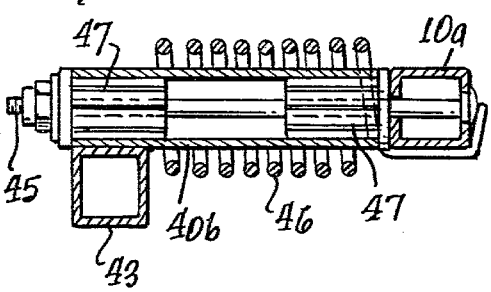
FIG. 14 is a sectional view taken at line 14—14 in FIG. 13.
Figure 13:
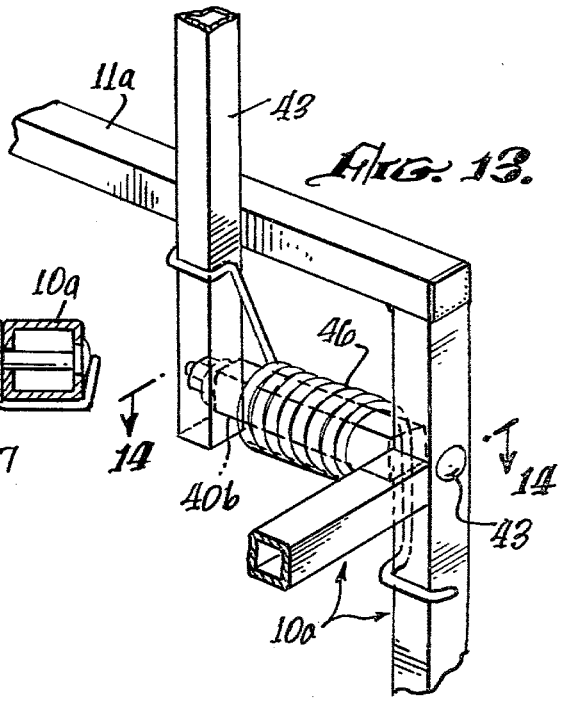
FIG. 13 is an enlarged partial perspective view of a portion of the apparatus of FIG. 12.

FIGS. 13 and 14 illustrate an alternative or modified form wherein a pair of short stub bars **40*b* are utilized instead of the rotatable back bar 40 of FIGS. 9 and 12, and springs 46. The stub bars are secured, as by welding, to the back support arms 43, and are pivotably mounted on the end frames by bolts 45. Plastic plug elements 47, which expand upon the tightening of bolts 45** in conventional manner, provide securement between the bolts and the stubs.

The inventor claims:

1. A convertible sofa-bed apparatus for use in either a sofa or a bed configuration, comprising:

a seat cushion unit and a back cushion unit hingedly interconnected, frame means supporting the back and seat cushion units and having front members, and at least one pivotable arm means pivotally connected with the frame front members and pivotally directly connected with the seat cushion unit, said arm means being rotatable through one-half revolution between a back horizontal position wherein the apparatus is in its sofa configuration and a frontward horizontal position wherein the apparatus is in its bed configuration, said back cushion unit being urged and displaced frontwardly and downwardly by its hinged connection with the seat cushion unit into a horizontal position adjacent to the seat cushion unit in the bed configuration of the apparatus.

2. A sofa-bed apparatus according to claim 1, wherein:

the frame means includes:

a pair of spaced end frames supporting the apparatus on a surface, and means interconnecting the end frames.

3. A sofa-bed apparatus according to claim 1 or claim 2, and further comprising:

a front cross-bar having end portions rotatably mounted between the frame front members, wherein said pivotable arm means comprises at least one bar secured to and extending from said front cross-bar for rotation therewith.

4. A sofa-bed apparatus according to claim 2, and further comprising:

support legs on the frontward portion of the seat cushion unit to support the unit in its frontwardly extending position in the bed configuration of the apparatus.

5. A sofa-bed apparatus according to claim 3, wherein:

said pivotable arm means comprises two arm bars rigidly secured in spaced relation to the rotatable front cross-bar.

6. A sofa-bed apparatus according to claim 2, wherein:

said means interconnecting the end frames includes a back frame member secured between the end frames.

7. A sofa-bed apparatus according to claim 6, wherein:

the back frame member is detachably secured to the end frames for convenient disassembly and assembly of the apparatus.

8. A sofa-bed apparatus according to claim 6, wherein:

said end frames and back frame members are fabricated of metal tubing of rectilinear cross-section.

9. A convertible sofa-bed apparatus for use in either a sofa or a bed configuration, comprising:

a seat cushion unit and a back cushion unit hingedly interconnected, frame means supporting the back and seat cushion units, at least one pivotable arm means pivotally connected with the frame means and pivotally connected with the seat cushion unit, said arm means being rotatable through one-half revolution between a back horizontal position wherein the apparatus is in its sofa configuration and a frontward horizontal position wherein the apparatus is in its bed configuration, said back cushion unit being urged and displaced frontwardly and downwardly by its hinged connection with the seat cushion unit into a horizontal position adjacent to the seat cushion unit in the bed configuration of the apparatus, a pair of spaced end frames supporting the apparatus on a surface, and means interconnecting the end frames, a back bar rotatably mounted between the end frames, and at least one back cushion support arm secured to said bar and pivotable therewith between a vertical position wherein it supports the back cushion unit in the sofa configuration of the apparatus, and a horizontal position wherein it supports the back cushion unit in the bed configuration of the apparatus.

10. A sofa-bed apparatus according to claim 8, wherein:

said pivotable arm means comprises two arm bars rigidly secured in spaced relation to the rotatable front cross-bar.

11. A sofa-bed apparatus according to claim 9, and further comprising:

biasing spring means interacting between the back cushion support arms and said end frames to urge the arms toward their vertical position to facilitate the manual urging of the apparatus from its bed to its sofa configuration.

12. A sofa-bed apparatus according to claim 11, wherein:

said spring means comprise helical torsion springs disposed about end portions of the back bar and engaging the rear frame member and the back cushion support arms to urge said arms into their vertical positions.

13. A sofa-bed apparatus according to claim 11, and further comprising:

a pair of stub bars respectively pivoted to respective ones on the end frames and secured perpendicularly to the respective back cushion support arms, and wherein the bias spring means are disposed about the respective stub bars to urge the back cushion support arms toward their vertical positions.

14. A sofa-bed apparatus according to claim 9, and further comprising:

a pair of arm rests detachably mounted when the apparatus is in its sofa configuration for removal thereof for insertion in a gap between the back and seat cushion units when in their horizontal position in the bed configuration of the apparatus.

* * * * *